United States Patent [19]

Hellmann

[11] Patent Number: 4,477,338

[45] Date of Patent: Oct. 16, 1984

[54] METHOD AND APPARATUS FOR PROCESSING HIGH-ASH COAL SLURRIES BY FLOTATION, PARTICULARLY FOR PROCESSING GAS COAL AND OPEN-BURNING COAL WHICH ARE DIFFICULT TO FLOAT

[75] Inventor: Karl Hellmann, Dorsten, Fed. Rep. of Germany

[73] Assignee: Ruhrkohle Aktiengesellschaft, Fed. Rep. of Germany

[21] Appl. No.: 356,319

[22] Filed: Mar. 9, 1982

[30] Foreign Application Priority Data

Mar. 9, 1981 [DE] Fed. Rep. of Germany ..... 3108913

[51] Int. Cl.[3] ..... B03B 1/00

[52] U.S. Cl. ..... 209/5; 209/167; 209/169; 209/170; 209/171; 366/153

[58] Field of Search ..... 209/2, 3, 4, 5, 9, 12, 209/162–172; 366/153

[56] References Cited

U.S. PATENT DOCUMENTS

| | | | |
|---|---|---|---|
| 955,012 | 4/1910 | Sulman | 209/166 |
| 1,310,051 | 7/1919 | Blomfield | 209/170 |
| 1,457,077 | 5/1923 | Janney | 209/168 |
| 1,921,220 | 8/1933 | Daman | 209/169 |
| 2,682,337 | 6/1954 | Hodges | 209/166 |
| 3,255,882 | 6/1966 | McCarty et al. | 209/168 |
| 3,735,931 | 5/1973 | Weston | 209/166 |
| 4,121,945 | 10/1978 | Hurst et al. | 209/10 |

FOREIGN PATENT DOCUMENTS

| | | | |
|---|---|---|---|
| 2095697 | 10/1982 | United Kingdom | 209/164 |

OTHER PUBLICATIONS

Dr. Fuerstenau—Froth Flotation—50th Anniversary vol. published by Am. Inst. of Mining, Metallurgical & Petr. Eng., 2/15/63, pp. 340, 341 & 539–567.

*Primary Examiner*—Bernard Nozick

*Attorney, Agent, or Firm*—Hill, Van Santen, Steadman & Simpson

[57] ABSTRACT

A method is proposed for processing high-ash coal sludges by flotation of a slurry in the cells of flotation units, particularly for processing gas coal and open burning coal which are difficult to float, in which the coal slurry to be processed flows through the cells of the flotation unit pre-conditioned and controllably, particularly with control of the dwell time. In a preferred embodiment, the control of the dwell time occurs by a controlled distribution of the slurry to cells of the flotation unit which operate in parallel. For the purpose of controlling the dwell time of the slurry in a flotation unit, cells which are traversed in parallel are additionally connected or disconnected as a function of operating parameters, such as slurry density or solids content or solids distribution.

39 Claims, 9 Drawing Figures

METHOD AND APPARATUS FOR PROCESSING HIGH-ASH COAL SLURRIES BY FLOTATION, PARTICULARLY FOR PROCESSING GAS COAL AND OPEN-BURNING COAL WHICH ARE DIFFICULT TO FLOAT

BACKGROUND OF THE INVENTION

1. Field of the Invention

The present invention relates to a method and to an apparatus for processing high-ash coal slurries by flotation of a sludge in the cells of flotation units, particularly for processing gas coal and open-burning coal which are difficult to float.

2. Description of the Prior Art

In hard coal processing, foam flotation is usually employed for the production of coal concentrate from high-ash coal slurries, particularly in the grain size range below 0.5 mm. Because of the increasing production of coal slurry, it is gaining greater and greater significance. The increasing production of coal slurry, as a result of increasing proportions of fine and finest material in the raw material, is a result of increasing mechanization in mining.

As a result of this development, there is a necessity to improve the known methods and apparatus for processing high-ash coal slurry, particularly foam flotation grading, and to automate the same, and to automate the same in consideration of the optimum operating points. However, relatively slight, carbonized "younger" bituminous coal whose slurry, moreover, is high in unsolidified, extremely finely-distributed argillaceous minerals which have a flotation-inhibiting effect, present particular difficulties.

As is known in the art, foam flotation is based on the method of dispersing gas or, respectively, air bubbles in the sludge liquid in order to therefore equip coal and middlings particles with the required buoyancy so that a surface foam arises which is high in coal components and low in attle or, respectively, ash components. Since the creation of gas bubbles and their proper distribution (among other things) are a function of time, if frequently occurs that no sufficient generation of gas bubbles occurs in the first cell of a flotation system. This is only achieved, to a satisfactory degree, in the second and following cells. Although this disadvantage can be countered with an increased plurality of cells, the capital expense and the energy and space requirements occasioned rise to a considerable degree.

It is further known that, given a high concentrate component of the sludge, the flotation material demonstrates a tendency to rise quickly and, as a closed mass, uncontrollably, to the top, whereby it entrains undesired components of argillaceous and shale minerals. Therefore, the cleans deteriorate. Thereby, the disruptive influence of flocculents becomes noticeable at the same time, the flocculents being employed in the pre-connected coal washing in order to cause sludges from washing processes in thickners to settle out with a high specific clarification surface mode. In a known manner, they effect an agglomeration of fine solids particles into larger structures with a higher sinking rate. In the following flotation process, however, the increase of the sinking rate causes a continuing disruption of the grading effect because the generally-insufficiently selective flocculents agglomerate attles particles, middlings and coal particles, as well as into undesired mixed structures. This leads to an increase of the coal component in the attles.

Thereby, further disadvantages result that flotation cells are generally connected in series, whereby the concentrate is stripped off in every cell, whereas the attles, which are contained in the respective sinks, traverse all cells. Therefore, an error propagation occurs, particularly regarding the flocculents. Thereby, optimally-set flotation cells having flocculent-free charges (laboratory conditions) operates significantly more favorably than operating systems in which all, partially counter-productive factors, have heretofore not been able to be taken into consideration. In the operating systems, it is particularly fluctuating charge amounts which lead to fluctuating selectivity and, therefore, to poor production results.

In the prior art, the known difficulties lead to multifarious solutions, for example, to flotation systems in which the attles of the after-flotation and/or the concentrate components, particularly of the first cells, were multiply retreated. In practice, however, none of the known flotation systems achieve the desired results over a long term. In particular, the coal component in the attles is too high.

SUMMARY OF THE INVENTION

The object of the present invention, therefore, is to optimize the flotation of hard coals in coal washings, particularly by improving the regulation and control of the flotation cells.

It is a further object of the invention to perfect the slurry conditioning with the attendant object of improved air bubble formation in the slurry aeration, as well as a reduction of the flotation-inhibiting effect of the flocculents carried over with the wash water.

Overall, as a result of the cooperation of individual, improved flotation conditions, the invention strives to achieve the yield of the purest-possible coal concentrate given an attles waste having the highest possible ash and the lowest possible coal content.

The above objects are achieved, according to the present invention, in that the coal to be processed traverses the cells of the flotation unit pre-conditioned and regulatable, particularly with the control of its dwell time. Therefore, it is advantageously achieved that the influencing factor "time" is sufficiently considered. In particular, it was surprisingly discovered that, particularly given high-ash hard coal slurries in the fine and finest grain size range, the dwell time of the slurry is of particular importance, particularly in traversal of the first cells, and should amount to several minutes.

It is proposed in accordance with a particular feature of the method of the invention that the control of the dwell time occurs by a controlled distribution of the slurry, preferably to cells of the flotation units which operate in parallel. By the amount-wise distribution of the slurry to parallel cells, the dwell time of the slurry in the cells can be advantageously matched to the changing charge amounts in such a manner that the dwell time of the slurry in the cells is constant within prescribed limits. Because one or more parallel cells can be optimally added and subtracted, the parameter "dwell time" can be adjusted within tight limits.

It is thereby provided in accordance with a feature of the invention that, for the purpose of controlling the dwell time of the slurry in a flotation unit, cells traversed in parallel are additionally connected or disconnected as a function of operating parameters such as slurry density, slurry amount per time unit, or ash content or solids distribution. Thereby, those influencing magnitudes are employed to a particular degree for the regulation or control of the dwell time which predominantly influence the result of a flotation method. It is thereby provided that the amount of slurry ($m^3/h$) introduced into the cell is dimensioned relative to the cell volume ($m^3$) in such a manner that the dwell time of the slurry in a cell, at least in the first cells, lies between 1 and 8 minutes, preferably between 2 and 3 minutes. An optimization of the flotation time in the individual cells, which depends within wide limits on the type, concentration and grain size range of the coal to be graded, as well as on the slurry density, the flotation agent and the gasification can thereby be determined without difficulty in tests (laboratory) by one skilled in the art. The invention then offers the possibility of optionally converting desired dwell times into action. Given external aeration and pre-conditioning, a dwell time of 2–3 minutes occurs as an optimum for gas coal and open-burning coal.

It is thereby proposed, in accordance with a further feature of the invention, that the charge amount, particularly the cells operating in parallel, is dimensioned in such a manner that the solids input per $m^2$ of foam flotation surface of the cell ($t/h \times m^{-2}$) lies below 10. Therewith, the flotation material containing the concentrate is offered sufficient foam flotation surface. It has been discovered that the selectivity of the flotation is further improved by so doing.

Whereas the connection and disconnection of individual parallel cells leads to relatively great control skips, it is provided that the level in the cells is separately adjustable for the purpose of a fine-graduated, and in particular, an individual control of the dwell time of the slurry in the individual cells or groups of cells.

In order to optimally control the regulatory operations, particularly in the adjustment and, preferably, in the individual adjustment of the dwell time of individual cells, it is further proposed, according to the invention, that the attles or ash content, or a corresponding residual coal content of the slurry or, respectively, of the wastes of individual cells be determined and that the dwell time be controlled in accordance with these contents.

Thereby, it is provided as a further, method-governing regulatory operation that a controlled, intermediate withdrawal of attles-containing waste be undertaken according to the attles or ash content, or according to a corresponding residual coal content, of the slurry or, respectively, of the waste.

It is further provided that the intermediate withdrawal of attles-containing waste is preferably undertaken at attles or ash contents of more than 65%. By so doing, it is advantageously avoided that the sinks, as was heretofore standard, load all series-connected cells, as a result of which the selectivity in the last cells deteriorated to an extraordinary degree. This disadvantage is avoided with the intermediate withdrawal according to the present invention.

Thereby, and in accordance with a further advantageous feature of the invention, the measurement of the attles, ash and/or coal content occurs by means of an ash identification device which preferably exhibits an X-ray or gamma radiator or occurs by means of a color testing device for measuring the color of the slurry. The application of these measuring methods, which are known per se, to the measurement of the attles, ash and/or coal content of the slurry in the flotation makes the slurry supervision of individual cells or groups of cells possible in an uncomplicated manner and with the lowest possible expense in terms of cost and maintenance. By so doing, a further advantageous result of the invention arises in an individual control and/or regulation of individual cells or groups of cells for the purpose of optimizing the overall method.

A further advantageous feature of the invention provides that the pre-conditioning occurs by means of the introduction of motive energy for the disaggregation of the agglomerates due to flocculents and/or introduction of air, particularly up to and beyond the saturation limit at normal pressure, given a dwell time of 1–10 minutes, preferably of approximately 2 minutes.

The advantageous effects of the individual conditioning measures are various in nature and their inventive cooperation leads to a significant improvement of the flotation result. As a result of introducing motive energy, particularly over a beating cross, the effect of the undesired flocculent intake into the slurry to be floated is eliminated, since the agglomerates previously formed are disaggregated and, surprisingly, no new agglomerates are formed. The introduction of air up to and beyond the saturation limit leads to the advantageous result that a uniform and brief formation of very fine foam bubbles occurs given entry of the slurry into the first cells. By so doing, the efficiency of a flotation unit is significantly improved. Thereby, it turns out that the intake bubble formation very advantageously effects that even coarser coal particles are buoyed up, this being extremely important for the overall yield of the coal. Therewith, a drawback frequently observed in the prior art is eliminated, that namely that it is only the finest component of the concentrate which is caused to flow in the first cells due to the preferred agglomeration of flotation oil to the finest components of the coal given an insufficient bubble formation at the same time, this leading to the fact that the average grain size of the flotation material constantly increases from cell-to-cell.

In the final result, this leads to the fact that a relatively large proportion of coal particles lying at the upper limit in the grain size range is discharged together with the sinks since, given the coarser grain in the last cells, the support provided by the fine and finest components in the flotation foam which is required for flotation was missing. By means of settling a dwell time of 1–10 minutes, preferably of approximately 2–3 minutes, the conditioning, on the one hand, is increased up to a sufficiently intensive degree whereas, on the other hand, an unnecessary energy consumption is avoided.

It is thereby further provided that the conditioning, particularly given addition of air in the overpressure range, is undertaken, if need be with the addition of flotation agents, in a range of 1.0–5 bar, preferably at 2 bar. The added addition of a portion of the flotation agent has the advantage that, due to the addition in cooperation with the violent agitation in which an approximately 4–6 fold circulation of the slurry is achieved, a moistening of the entire grain size range, including the coarser particles, is achieved, i.e. not, as in the prior art, a predominantly intense hydrophobation of the finest components, whereby the hydrophobation of the coarser particles was previously neglected in a disadvantageous manner.

By introducing air in the overpressure range, an over saturation of the liquid is achieved so that, given the automatically-occurring relaxation of the slurry at the moment it is introduced into the cells, a spontaneous creation of fine and finest gas bubbles occurs at the surfaces of the coal particles which were correspondingly prepared by the pre-conditioning, whereby the flotation is spontaneously begun. According to the invention, moreover, the conditioning is not restricted to the pre-flotation but, rather, it is provided that the batching of the after-flotation is likewise subjected to a pre-conditioning.

Finally, the method of the invention advantageously provides, as a further control-technical measure and feature thereof, that the air allocation of the cells is differently-controlled according to the content in the slurry of solids and/or according to the grain size in the residual coal. In a particular manner, this measure intends to cause even the coarser coal particles, which have frequently ended up in the sinks in the last cells due to a lack of buoyancy, to float to the top, particularly in the slurry having reduced solids content as a result of the intermediate withdrawal of a portion of the attles containing sinks.

A device for implementing the method, according to the present invention, having flotation cells traversed by the slurry, is characterized in that it comprises at least two cells or rows of cells operating in parallel, particularly in the charging area, which preferably exhibit an individually adjustable level control.

Thereby, it is further provided that, at the charging side, it exhibits a group of three cells or rows of cells in parallel connection and, following thereupon, a group of two cells or two rows of cells in parallel connection. This inventive disposition has the advantage that the specific load of the cells in the through-put direction can be maintained approximately constant, whereby the slurry reduced in coal content from cell-to-cell is floated in the charging area with a relatively long dwell time and which shorter dwell times in the cells towards the discharge side.

An advantageous, further feature of the invention provides that the cells comprise measuring installations which preferably function continuously for the purpose of measuring the slurry density, these being particularly disposed at the connecting locations of the individual rows of cells.

It is further provided that the cells or rows of cells exhibit devices for level control, particularly intermediate withdrawal devices or weirs. In this manner, the dwell time control, in accordance with the present invention, is possible in terms of apparatus engineering.

Further, a pre-conditioning container is provided, according to the present invention, in a flotation device, exhibiting an aggitator having, preferably, sharp-edged aggitator elements and having means for the introduction and for the control of compressed air. It is thereby proposed that the conditioning container be an autoclave-like pressure container which is equipped with means for level control of the slurry surface and, if necessary, is equipped with means for the metered introduction of flotation oil. Therefore, both the dwell time and the oversaturation and pre-hydrophobation can be controlled, and the advantageous multi-component preconditioning can be executed according to the invention.

BRIEF DESCRIPTION OF THE DRAWINGS

Other objects, features and advantages of the invention, its organization, construction and operation will be best understood from the following detailed description, taken in conjunction with the accompanying drawings, on which.

FIGS. *7a* and *7b* are schematic representations of another embodiment of a flotation system according to the present invention, illustrated as comprising a total of eight cells disposed in parallel in respective pairs and three following individual cells.

DESCRIPTION OF THE PREFERRED EMBODIMENTS

Figure 1:
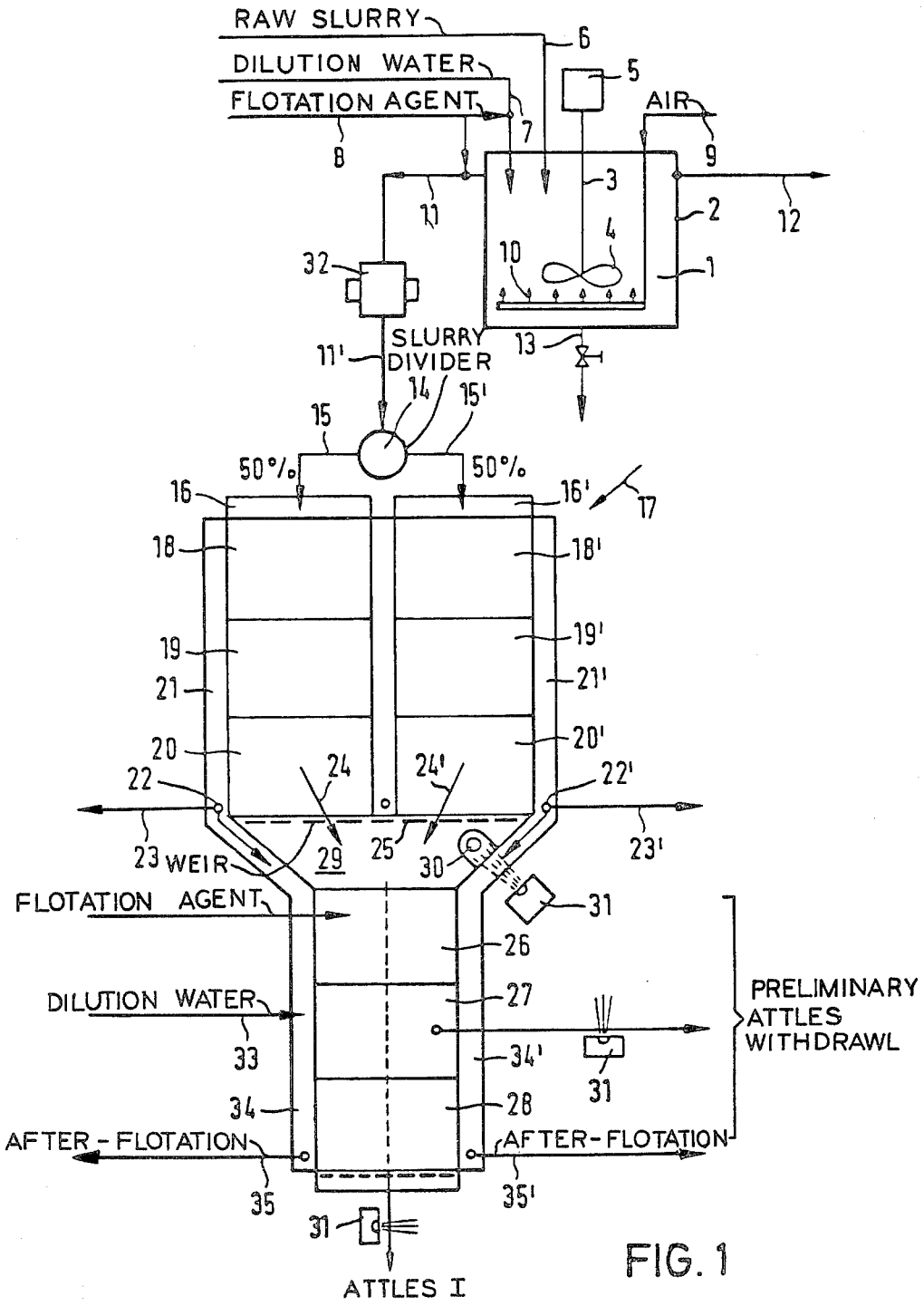
FIG. 1 is a schematic diagram of a flotation unit, having a conditioning device.

Referring to FIG. 1, a conditioning device 1 comprises a closed container 2. An agitator 3 having agitating elements 4 and a drive 5 is located in the container 2. Further located at the container 2 are an intake 6 for raw slurry, an intake 7 for dilution water and an intake 8 for flotation oil. Compressed air is fed to the distributor nozzles 10 by way of a line 9. A discharge 11 for the conditioned slurry is located at the one side of the container 2, whereas an overflow 12 is indicated at the other side. In case the container 2 must be emptied, a discharge 13 is provided in the floor of the container, which can be closed off, of course.

Conditioned slurry is fed through a line 11' into a slurry divider 14 where it is divided and delivered through the lines 15, 15' into the intakes 16, 16' of the flotation unit 17. At its input side, the flotation unit 17 is equipped with six cells of which three respective cells 18, 19 and 20, connected in series, form one group which, with a parallel group of identical cells 18', 19' and 20', which are likewise connected in series, are traversed in the same direction by the slurry which has been divided with respect to amount. Concentrate collected in the floating material is laterally discharged to a plurality of collecting channels 21, 21' and, if necessary, it is withdrawn at discharge locations 22, 22', as indicated by the arrows 23, 23'. Depending upon its constitution, the concentrate is dewatered for immediate further employment or, in the case of an ash content which may still be too high, is subjected to an after-flotation. The slurry, as indicated by arrows 24, 24' flows out of the parallel cells 18, 18'; 19, 19'; 20, 20' over a level-regulating device 25, for instance a weir, through the connecting chamber 29 and into following series-connected cells 26, 27, 28.

Located in the intermediate chamber 29, as well as at the attles taps, is an ash identification device or a simple density float 30 which is sensed, contact-free regarding its immersion depth, by an electronic sensing device 31 located outside of the chamber 29. The identified ash content or the immersion depth, which represents a measure of the slurry density, is compared to a corresponding value which the ash identification device or the slurry density measuring device 32 determines in the intake line 11'. Depending upon the measure of the determined values, operations are undertaken in the control of the flotation unit 17 as needed upon consideration of the charge slurry amount such as, for example, an additional connection or disconnection of individual parallel cells or a change of the slurry level in the cells, for example, by actuating the level regulating device 25. Under certain conditions, a change of the feed amount of flotation means or a change of the air entry also come into consideration.

The corresponding regulatory and control devices which are known to one skilled in the art and form part of the prior art are not illustrated in the exemplary embodiment for reasons of clarity.

An addition of dilution water, as indicated by an arrow 33, is provided as a further control and/or regulatory operation, as is, if need be a preliminary attles withdrawal at one of the cells 26 or 27. The concentrate discharge of the cells 26–28 from the discharge channels 34, 34' is, as indicated by the arrows 35, 35', supplied to an after flotation mechanism which is not illustrated in FIG. 1, whereas the attles discharge (attles I) is supplied to a sludge thickening, whereby the thickened attles are dumped in a known manner and the overflow is fed back into the wash water circulation of the coal wash.

Figure 2:
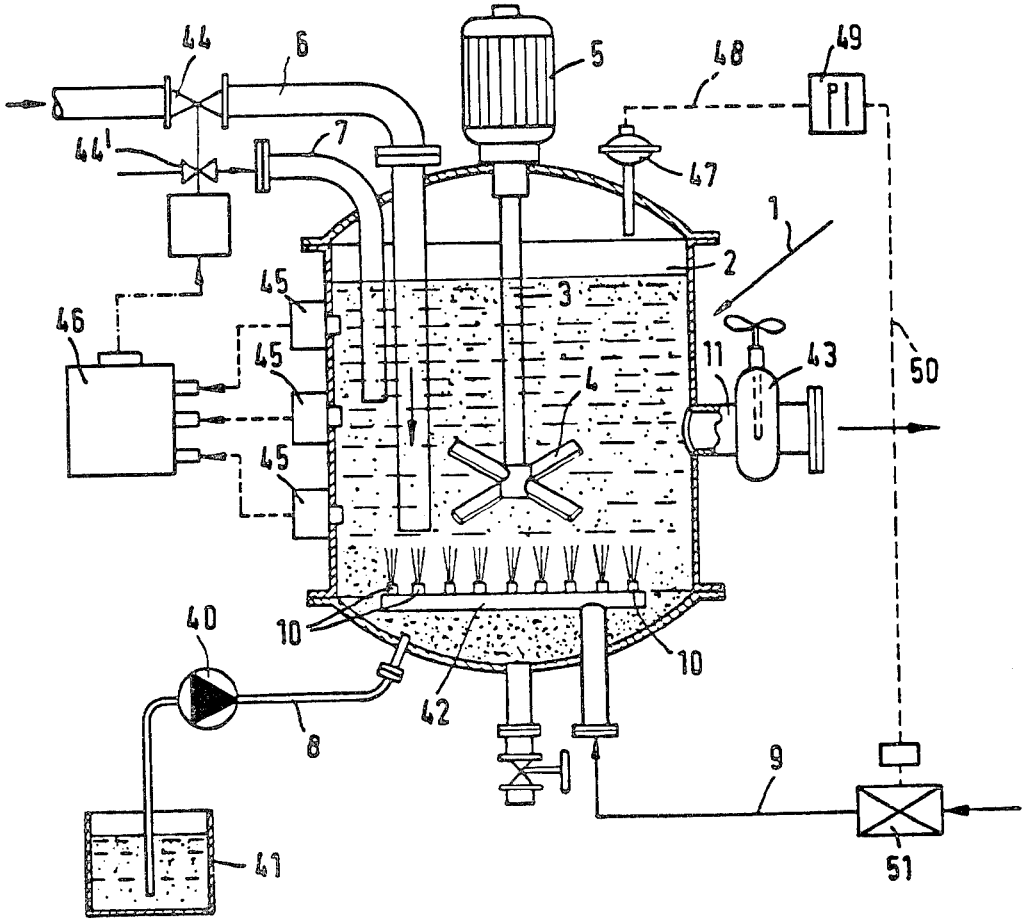
FIG. 2 is a schematic illustration of a flotation device corresponding to that of FIG. 1, illustrated in section.

Referring to FIG. 2, the conditioning device 1 is again illustrated as comprising the container 2, the agitator 3 with the agitator elements 4 and a drive 5, as well as the intake 6 for raw slurry, the intake 7 for dilution water and the intake 8 for flotation oil. A metering pump 40 having a supply reservoir 41 for the flotation oil provided for this purpose is only schematically illustrated. The illustration further shows the air conduit 9 for compressed air having a nozzle rail 42 carrying a plurality of air input nozzles 10. A throttle element disposed in the discharge nozzle 11 and a, preferably, electro-mechanically adjustable throttle element 44 is likewise disposed in the intake 6 for raw sludge, as is the throttle element 44' in the water line 7. Level indicators 45, which determine the height of the liquid level in the container 2 are located at the one side of the container 2. A value corresponding to the level height is forwarded by control lines to a control unit 46 which, depending upon the prescribed rated level value, adjusts the intake of raw material and/or dilution water with the assistance of the throttle elements 44, 44'. A pressure measuring device 47 is located in the upper portion of the container and transmits a control signal over a signal line 48 to a switch device 49 which, with the assistance of a control line 50 and a control element 51, sets the feed of compressed air into the conditioned slurry.

Figure 3:
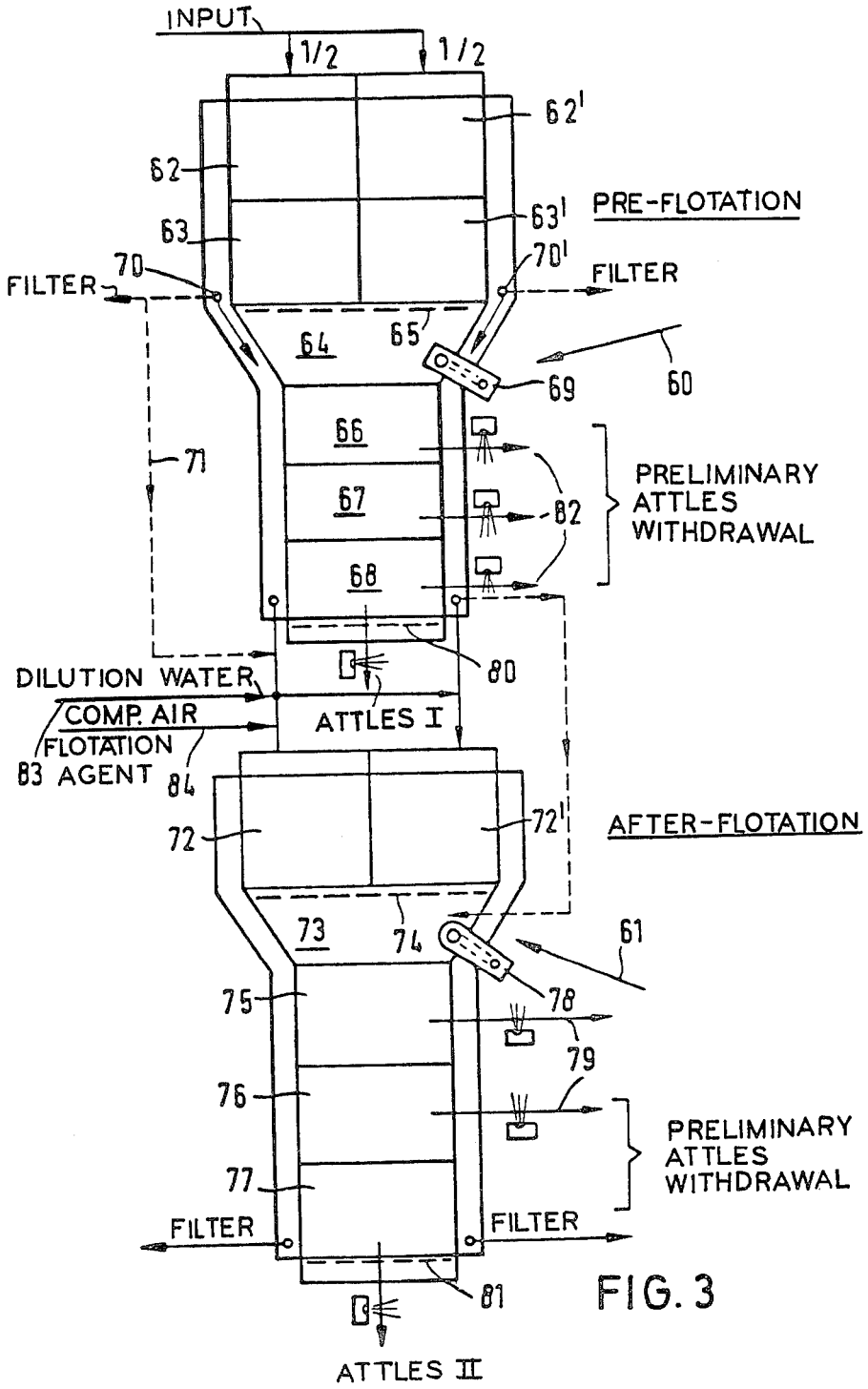
FIG. 3 is a schematic representation of a flotation system comprising a pre-flotation unit and an after-flotation unit.

FIG. 3 illustrates a flotation system having a pre-flotation unit 60 and an after-flotation unit 61. In FIG. 3, the pre-flotation unit 60 comprises, at its input side, a plurality of cells 62, 63; 62', 63' connected in parallel in respective pairs which are followed in series by a plurality of cells 66, 67 and 68 over an intermediate container 64 which is equipped with a level control device 65. A measuring device 69 for the ash content or slurry density, similar to the measuring elements 30, 31 in FIG. 1, are disposed at the intermediate container 64 or at the attles discharges. A first concentrate is withdrawn at locations 70 and 70' and, if need be, is supplied to a filter for dewatering.

Depending upon its quality, this concentrate can be entirely or partially after-floated. This is indicated by the connecting line 71. Preliminary attles withdrawals can be undertaken from the cells 66–68 insofar as the concentration in the attles content of the sinks has reached corresponding level which can be determined in a known manner by determining the ash content, particularly by spontaneous determination with X-rays, gamma rays or the like. Given this system, also, for example in the pre-flotation unit 60, the dwell time of the slurry can be controlled as required in larger control skips by the additional connection or disconnection of parallel cells 62, 62' 63, 63', this being undertaken in adaptation to the charge amount and/or slurry density of the charge, or being controlled by a fine setting by the level change with the assistance of the level setting device 65 in the parallel cells 62, 62', 63, 63'.

An analogous case holds true with respect to the after-flotation unit 61 in whose intake area two parallel cells 72, 72' are disposed. From there, the slurry depleted in solids content due to the withdrawal of concentrate and the preliminary withdrawal of attles-containing sinks proceeds through the intermediate container 73 having a level control device 74 and into the following individual cells 75, 76, 77 from which preliminary attles withdrawals, indicated by the arrows 79, can be undertaken, if necessary, according to the measure of the value measured with the slurry density measuring device 78. If need be, a control of the level setting devices 74, 80 and 81 is undertaken for optimizing the dwell time. Further control or regulation possibilities are provided by intermediate introduction of dilution water 83 or of compressed air 84, as is known per se.

Figure 4:
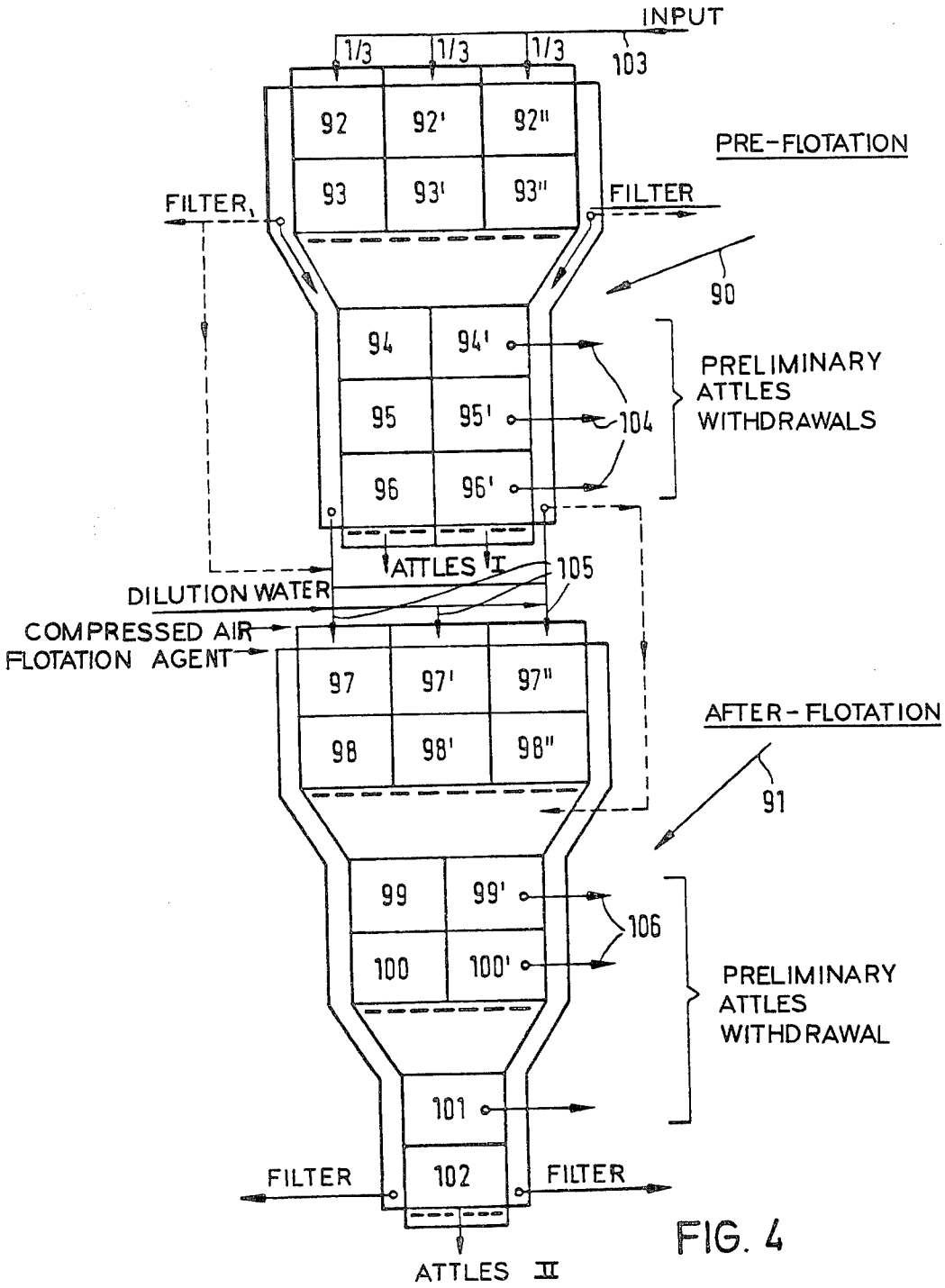
FIG. 4 is a schematic illustration of a flotation system, comprising a pre-flotation unit and an after-flotation unit, a triple-parallel disposition of cells in the charging area, a double-parallel disposition of cells in the discharge area, and cells individually connected in series in the discharge area in the after-flotation unit.

FIG. 4 illustrates a two-stage pre-flotation apparatus 90 and a three-stage after-flotation apparatus 91. A batch 103 of the conditioning slurry is subdivided in a known manner into three approximately equal streams each having one-third of the total amount. Cells 92, 92', 92'' and 93, 93', 93'' are connected in respective sets of three in the intake area of the pre-flotation apparatus 90. In the manner already set forth above with respect to the drawings and associated text, the slurry, after withdrawal of the first pre-concentrate and discharge thereof into a dewatering device, arrives over a level regulating device and an intermediate container into the following cells of the pre-flotation apparatus 90 which, in the case of the illustrated system, are connected in parallel by twos and are referenced with the characters 94, 94', 95, 95', 96, 96'. As indicated by the arrows 104 a preliminary withdrawal of attles-containing sinks is provided from these cells in case such is necessary according to the slurrv density termination, as illustrated and described with respect to the preceding drawings.

From the pre-flotation apparatus 90, the remaining slurry, again after discharge into three sub-flows as indicated by the arrows 105, proceeds into the cells 97, 97', 97'', 98, 98', 98'' connected in parallel in threes in the intake area of the after-flotation apparatus 91 and proceeds therefrom over a schematic-indicated level control device and an intermediate container, as has already been described above, into following cells 99, 99', 100, 100' which are connected in parallel by twos. By a disposition of the three or two cells, a control of a dwell time of the slurry while traversing the cells is ideally possible and within relatively broad limits with the assistance of the added connection or disconnection of parallel cells.

As indicated by the arrows 106, a preliminary attles withdrawal is likewise possible and is provided from the cells 99, 99', 100, 100' insofar as such a measure seems advantageous on the basis of the corresponding measured values of the slurry contents. From there, the remaining slurry again proceeds over a level controlling device and an intermediate container into the last cells 101, 102. Further control operations as derived, for example, from the addition of dilution water, compressed air or flotation oil, can likewise be undertaken, as has already been described above.

Figure 5:
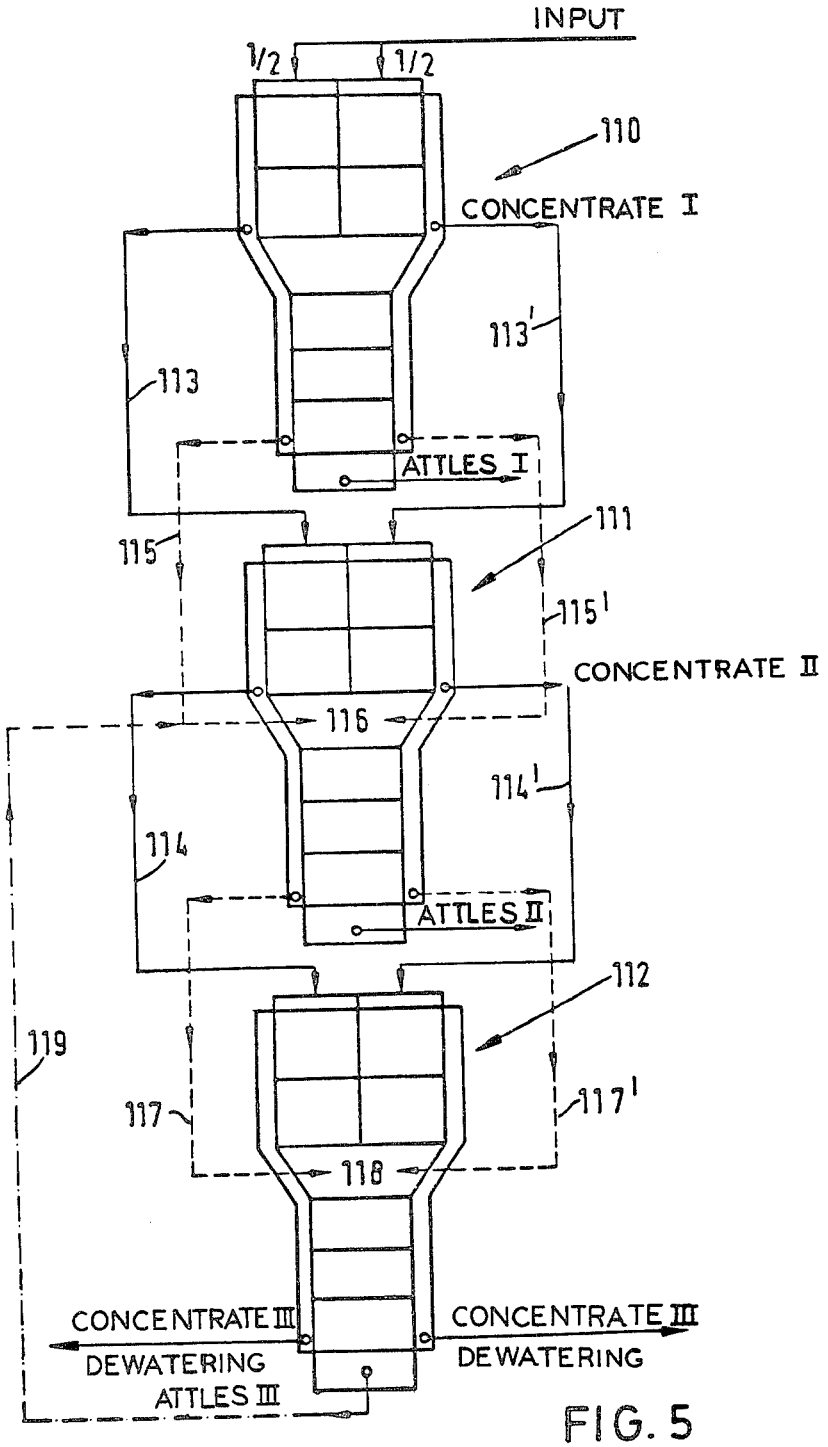
FIG. 5 is a schematic illustration of a flotation system containing four flotation units.

FIG. 5 illustrates an alternative disposition of three flotation units 110, 111, 112 connected in series. The concentrate I is delivered from the pre-flotation unit 110 through lines 113, 113' to the after-flotation unit 111 and the concentrate II is delivered from the after-flotation unit 111 through the lines 114, 114' to the after-flotation unit 112. The intermediate concentrate is respectively delivered with the lines 115, 115' into the intermediate container 116 of the next-following flotation unit 111, whereas an intermediate concentrate of the flotation unit is delivered by way of the lines 117, 117' into the intermediate container 118 of the last flotation unit 112. The sinks attles III of the last stage 112 are recirculated by way of a line 119 into the intermediate container 116 of the flotation unit 111. Thereby, the operations, as well as the regulation control possibilities of the three flotation unit 110, 111 and 112 correspond to the above-described flotation units of the preceding drawings.

Figure 6:
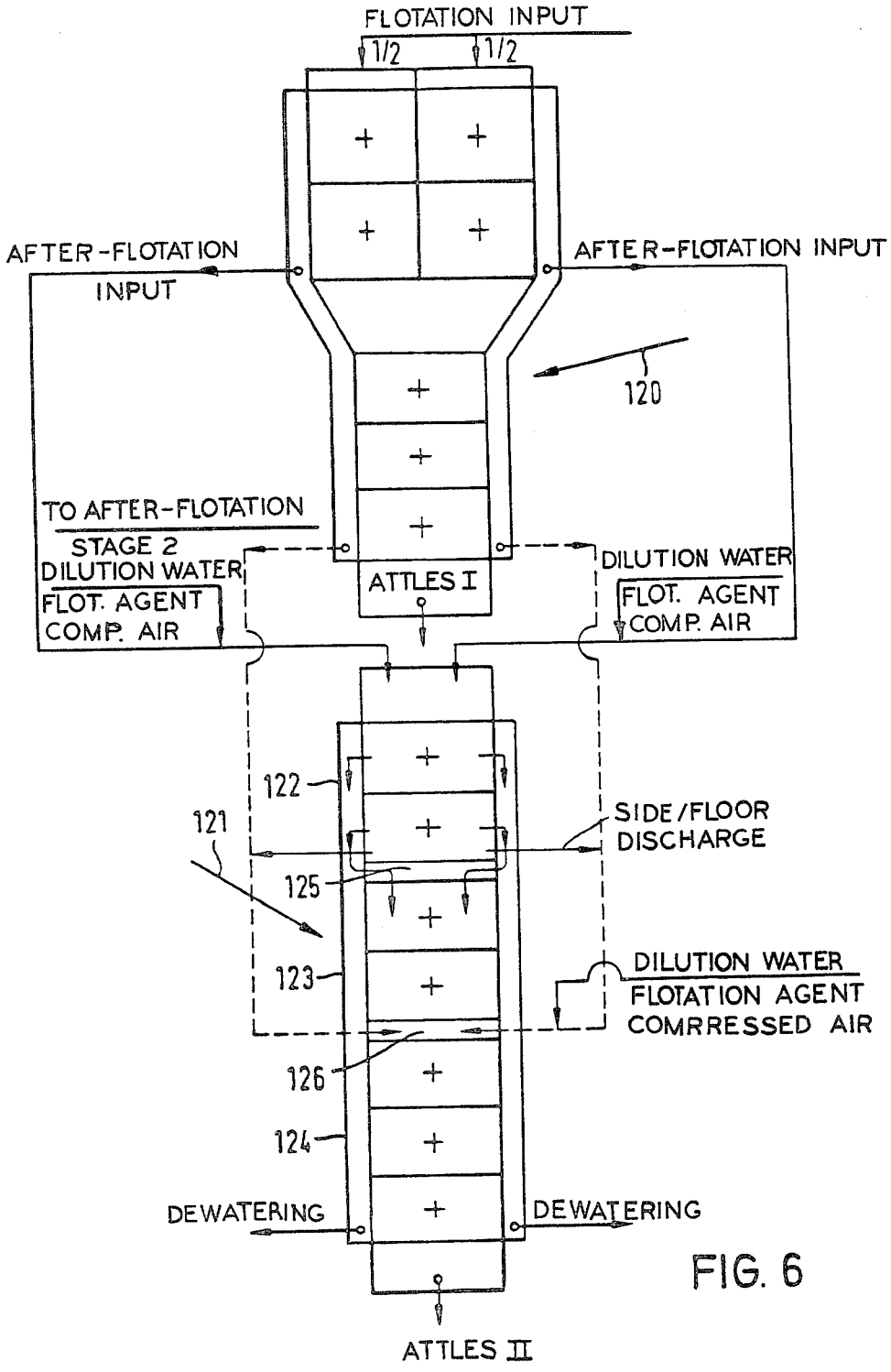
FIG. 6 is a schematic representation of another embodiment of a flotation system according to the present invention comprising a pre-flotation unit and an after-flotation unit.
Figures 7A, 7B:
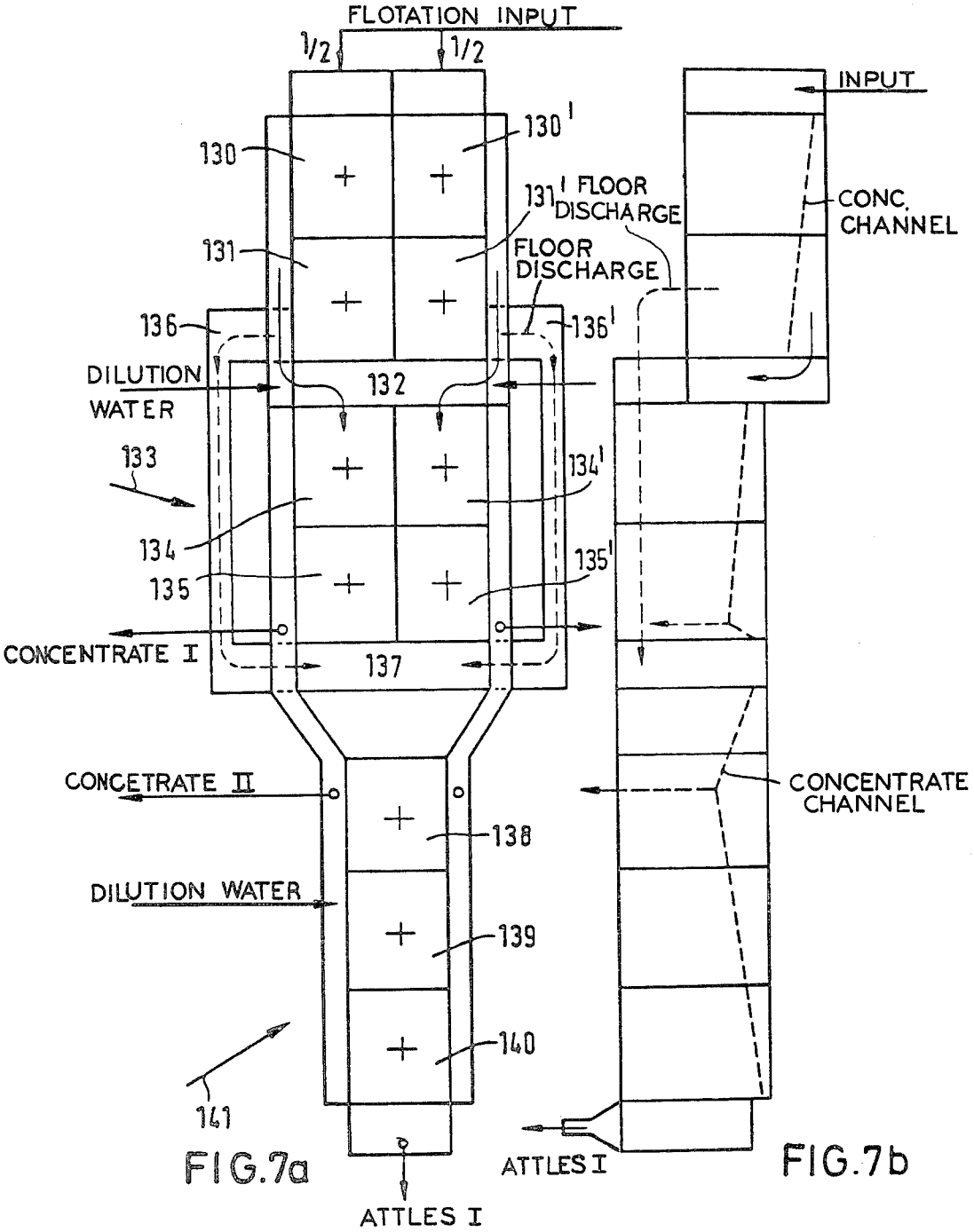
Figure 8:
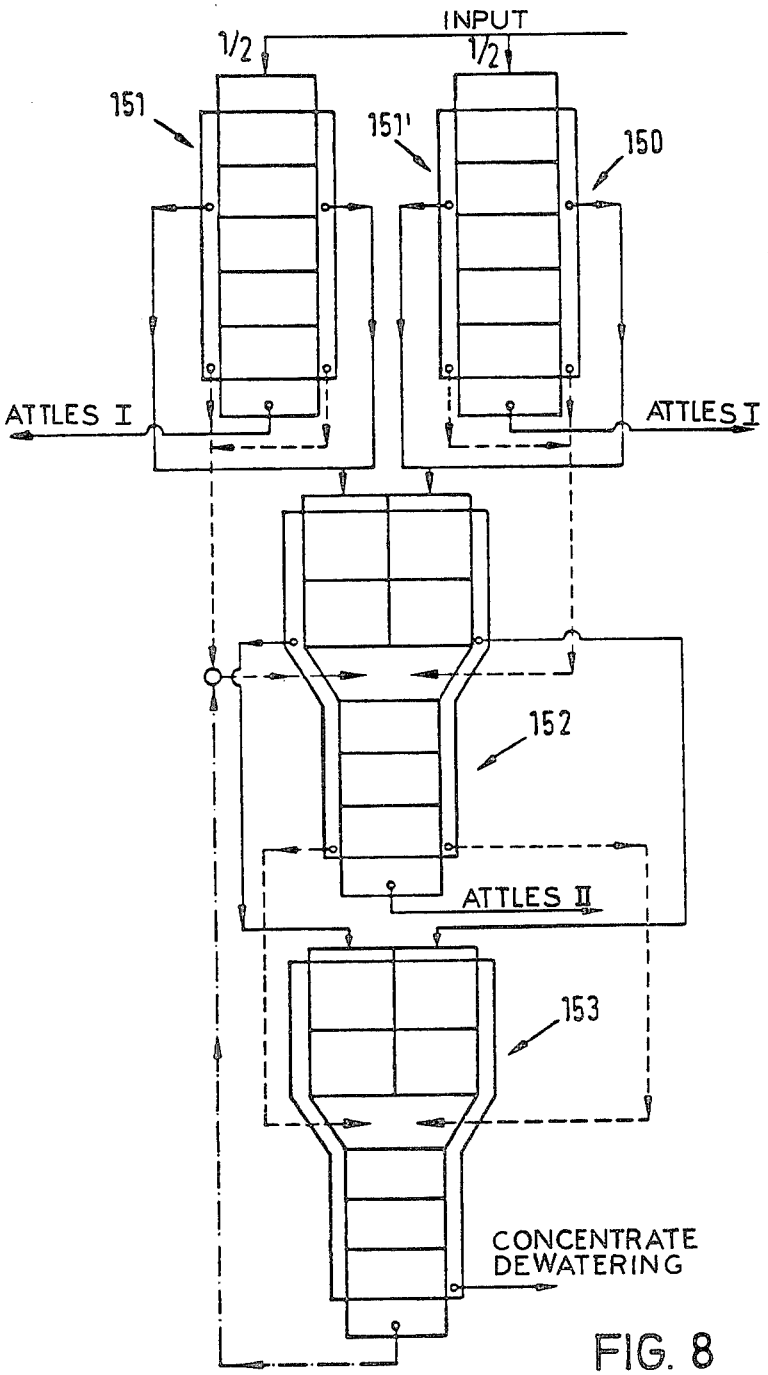
FIG. 8 is a schematic diagram of a three-stage flotation system having two groups connected in parallel, each group comprising five respective cells connected in series in the pre-flotation unit to which there are connected two after-flotation units having two-by-two cells connected in parallel and three following, series-connected cells.

Further, optional disposition possibilities of pre-flotations and after-flotations are illustrated in FIGS. 6, 7 and 8. Thereby, the pre-flotation unit 120 in FIG. 6 corresponds in terms of structure and disposition to the pre-flotation unit 60 in FIG. 3. In contrast thereto, the after-flotation unit 121 comprises series-connected groups 122, 123, 124 which are respectively composed of at least two series-connected individual cells and which merge into one another by means of intermediate containers 125, 126 which are equipped (not illustrated) with level regulators and measuring devices in the manner already set forth above. The measuring and level controlling devices are not shown for reasons of clarity.

A combination of the pre-flotation and after-flotation into a single, compact stage flotation unit is illustrated in FIG. *7a*. Thereby, in a first stage the pre-flotation unit encompasses four cells 130, 130', 131, 131' disposed in parallel by twos. These, as illustrated in the side view of FIG. *7b*, are provided in an elevated arrangement in comparison to the following cells and are connected over the intermediate container 132 to the next center stage 133 which, in turn, likewise comprises four individual cells 134, 134', 135, 135' respectively disposed in parallel by twos. Thereby, the collecting channels 136, 136' for floor withdrawal are conducted around the center stage 133 and discharged into the intermediate container 137 to which the last discharge-side stage 41 is connected, the stage 141 comprising three individual series-connected cells 138, 139 and 140.

Finally, FIG. 8 illustrates a pre-flotation unit 150 which comprises the two cell groups 151, 151' disposed in parallel which are composed of five respective series-connected individual cells. Connected thereto are a center flotation unit 152 and an after-flotation unit 153.

The center flotation unit 152 and the after-flotation unit 153 are similar or, respectively, identical, in terms of structure, to the cell arrangement of one of the units 120 according to FIG. 6 or 60 according to FIG. 3. The overall arrangement according to FIG. 8 particularly illustrates the magnitude of possible flows of the throughput flows such as, for example, stage-wise recirculations of concentrates or attles-containing material and the possibilities for regulation and/or control of the flotation system deriving therefrom in conjunction with the dwell time control of the present invention.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scooe of my contribution to the art.

I claim:

1. A method of processing high-ash coal slurry by flotation of the slurry in flotation cells, comprising the steps of:

preconditioning the slurry in a preconditioning tank with floatation agents and air injection, applying motion to the slurry, under pressure, for the disaggregation of the solids or floculent conglomerates due to floculent in the wash water;

flowing the slurry through a plurality of cells in parallel of a flotation apparatus to separate the slurry into froth and tails; and controlling the dwell time of the slurry as it traverses the cells.

2. The method of claim 1, wherein the step of introducing air is further defined as:

introducing air up to the saturation limit at normal pressure.

3. The method of claim 1, wherein the step of introducing air is further defined as:

introducing air beyond the saturation limit at normal pressure.

4. The method of claim 1, wherein the step of introducing air is further defined as:

controlling the air introduced into the individual cells in accordance with the solids content of the slurry.

5. The method of claim 1, wherein the step of introducing air is further defined as:

controlling the air introduced into the individual cells in accordance with the grain size of the residual coal.

6. The method of claim 1, wherein the step of introducing air is further defined as:

introducing air in an excess pressure of 2 bar.

7. The method of claim 1, wherein the step of controlling is further defined as:

separately adjusting the level of the slurry in the individual cells to control the dwell time.

8. The method of claim 1, comprising the steps of:

measuring the attles content of the slurry; and controlling the dwell time in accordance with the attles content.

9. The method of claim 1, comprising the steps of:

measuring the ash content of the slurry; and controlling the dwell time in accordance with the ash content.

10. The method of claim 1, comprising the steps of:
measuring the attles content of the waste of an individual cell; and
controlling the dwell time in accordance with the attles content.

11. The method of claim 1, comprising the steps of:
measuring the ash content of the waste; and
controlling the dwell time in accordance with the ash content.

12. The method of claim 1, wherein the step of controlling is further defined as:
measuring the attles content of the waste; and
withdrawing attles-containing waste in accordance with the attles content.

13. The method of claim 1, wherein the step of controlling is further defined as:
measuring residual coal content of the slurry; and
withdrawing attles-containing waste in accordance with the residual coal content of the slurry.

14. The method of claim 1, wherein the step of controlling is further defined as:
measuring the residual coal content of the waste; and
withdrawing attles-containing waste in accordance with the residual coal content of the waste.

15. The method of claim 1, wherein the step of controlling is further defined as:
measuring at least one predetermined operating parameter; and
connecting and disconnecting the parallel-operating cells as a function of the measured operating parameter.

16. The method of claim 15, wherein the step of controlling is further defined as:
charging the parallel-operating cells with an amount of slurry which is dimensioned such that the solids input per $m^2$ of foam flotation surface of a cell ($t/h \times m^{-2}$) lies below 10.

17. The method of claim 1, wherein the step of controlling is further defined as:
introducing an amount of slurry into a cell in relationship to the cell volume such that the dwell time of the slurry in at least the first cells lies in a range of between 1 and 8 minutes.

18. The method of claim 17, wherein the step of introducing is further defined as:
introducing the amount of slurry in relationship to the cell volume such that the dwell time of the slurry in at least the first cells lies in a range of between 2 and 3 minutes.

19. The method of claim 1, wherein the step of controlling is further defined as:
measuring the ash content of the waste; and
withdrawing attles-containing waste in accordance with the ash content.

20. The method of claim 19, wherein the step of withdrawing is performed in response to an ash content of greater than a predetermined percentage.

21. The method of claim 20, wherein the predetermined percentage is selected to be 65%.

22. The method of claim 1, wherein the step of controlling is further defined as:
measuring the attles content of the waste; and
withdrawing attles-containing waste in accordance with the attles content.

23. The method of claim 22, wherein the step of withdrawing is performed in response to an ash content of greater than a predetermined percentage.

24. The method of claim 1, wherein the step of controlling is further defined as:
measuring a predetermined parameter; and
adjusting dwell time in accordance with the measured parameter.

25. The method of claim 24, wherein the predetermined parameter is selected to be the attles content.

26. The method of claim 24, wherein the predetermined parameter is selected to be the ash content.

27. The method of claim 24, wherein the predetermined parameter is selected to be the coal content.

28. The method of claim 24, wherein the step of measuring is further defined as:
applying and measuring X-ray penetration of the slurry.

29. The method of claim 24, wherein the step of measuring is further defined as:
applying and measuring gamma ray penetration of the slurry.

30. The method of claim 24, wherein the step of measuring is further defined as:
measuring the color of the slurry.

31. The method of processing high-ash coal slurry by flotation of the slurry in flotation cells, comprising the steps of:
preconditioning the slurry in a preconditioning tank with floatation agents and air injection, applying motion to the slurry, under pressure, for the disaggregation of the solids or floculent conglomerates due to floculent in the wash water, including agitating the slurry prior to feeding the same to the flotation cells;
flowing the slurry through a plurality of cells in parallel of a flotation apparatus to separate the same into froth and tails; and
controlling the dwell time of the slurry as it traverses the cells.

32. Apparatus for processing high-ash coal slurry, comprising:
a preconditioning container including an agitator for agitating the slurry;
control means connected to said container for introducing compressed air therein;
said container being an autoclave-like pressure container and including level detection;
means connected to said level detection means operable in response to the sensed level to control the additional flotation agents into said container;
at least two rows of flotation cells for material separation arranged with said rows operating in parallel, each of said rows adapted to receive, as input material, a respective portion of the slurry; and
each of said rows including an adjustable level control device for controlling dwell time of the slurry.

33. The apparatus of claim 32, wherein said apparatus includes:
a slurry input comprising three parallel operating cells defining the beginnings of the rows.

34. The apparatus of claim 32, and further comprising:
measuring devices at predetermined locations for measuring the slurry ash content.

35. The apparatus of claim 32, and further comprising:

measuring devices at predetermined locations for measuring the coal content.

36. The apparatus of claim 32, wherein said level control devices comprise weirs.

37. The apparatus of claim 32, wherein said level control devices comprise intermediate withdrawal devices.

38. The apparatus of claim 32, wherein said agitator comprises sharp-edged rotatable elements.

39. The apparatus of claim 32, and further comprising:

means for connecting and disconnecting the flotation cells to control the dwell time of the slurry.

* * * * *